US005258691A

United States Patent [19]

Dakin et al.

[11] Patent Number: 5,258,691

[45] Date of Patent: Nov. 2, 1993

[54] METAL HALIDE LAMP HAVING IMPROVED OPERATION ACOUSTIC FREQUENCIES

[75] Inventors: James T. Dakin, Shaker Heights; Kenneth S. King, Willoughby Hills; Gary R. Allen, Chesterland, all of Ohio

[73] Assignee: General Electric Company, Schnectady, N.Y.

[21] Appl. No.: 897,601

[22] Filed: Jun. 10, 1992

Related U.S. Application Data

[63] Continuation of Ser. No. 612,381, Nov. 14, 1990, abandoned.

[51] Int. Cl.[5] ..... H01J 17/04; H01J 5/16; H01J 61/04

[52] U.S. Cl. ..... 313/620; 313/113; 313/622; 313/631

[58] Field of Search ..... 313/113, 620, 621, 622, 313/625, 631

[56] References Cited

U.S. PATENT DOCUMENTS

| | | | |
|---|---|---|---|
| 2,714,686 | 8/1955 | Isaacs et al. | 313/620 |
| 2,714,687 | 8/1955 | Isaacs et al. | 313/620 |
| 3,219,870 | 11/1965 | Gottschalk | 313/625 |
| 3,517,248 | 6/1970 | Eckel | 313/620 |
| 3,684,908 | 8/1972 | Beese | 313/113 |
| 3,988,626 | 10/1976 | Boudouris | 313/113 |
| 4,138,621 | 2/1979 | Downing et al. | 313/113 |
| 4,190,786 | 2/1980 | Kira | 313/113 |
| 4,387,319 | 6/1983 | White et al. | 313/620 |
| 4,724,361 | 2/1988 | Wada et al. | 313/631 |
| 4,799,135 | 1/1989 | Inukai et al. | 313/113 |
| 4,868,458 | 9/1989 | Davenport et al. | 313/113 |
| 4,968,916 | 11/1990 | Davenport et al. | 313/113 |

FOREIGN PATENT DOCUMENTS

| | | | |
|---|---|---|---|
| 106892 | 3/1939 | Australia | 313/620 |
| 1458906 | 2/1989 | U.S.S.R. | 313/620 |

*Primary Examiner*—Donald J. Yusko
*Assistant Examiner*—John E. Giust
*Attorney, Agent, or Firm*—George E. Hawranko; Stanley C. Corwin

[57] ABSTRACT

Asymmetric discharge electrode means are provided for a metal halide lamp enabling improved operation at acoustic frequencies. A xenon-metal halide lamp employing such improved discharge electrode means is disclosed together with a reflector lamp unit employing such lamp construction for its light source.

7 Claims, 2 Drawing Sheets

METAL HALIDE LAMP HAVING IMPROVED OPERATION ACOUSTIC FREQUENCIES

This application is a continuation of application Ser. No. 07/612,381, filed Nov. 14, 1990 now abandoned.

RELATED PATENT APPLICATIONS

A method and operating circuit means for stabilized acoustic operation of metal halide lamps is disclosed in U.S. patent application Ser. No. 07/579,129, filed Sep. 6, 1990, in the names of Gary R. Allen, John M. Davenport, Richard L. Hansler and Joseph M. Allison, and assigned to the assignee of the present invention now U.S. Pat. No. 5,121,034. The entire contents of the patent application are specifically incorporated herein by reference since the same method and circuit means can be utilized to operate the improved lamp construction of the present invention. A second commonly assigned U.S. patent application Ser. No. 07/608,084 filed Nov. 1, 1990 in the names of Timothy P. Dever, Gary R. Allen, John M. Davenport and Gerald E. Duffy, now U.S. Pat. No. 5,107,165, further discloses anode and cathode means which are advantageously modified in accordance with the present invention to provide less light loss during lamp start-up.

BACKGROUND OF THE INVENTION

This invention relates generally to an improved metal halide lamp for stabilized operation at acoustic frequencies and more particularly to an asymmetric electrode configuration in such type lamp providing an improved light source when so operated.

Various metal halide discharge lamps commonly employ a fused quartz arc tube as the light source by reason of the refractory nature and optical transparency of this vitreous ceramic material. In such type lamps the arc tube generally comprises a sealed envelope formed with fused quartz tubing having spaced apart discharge electrodes hermetically sealed at the ends thereof to provide an arc gap therebetween which is centered in the envelope cavity. A common arc tube shape employed for automotive vehicle applications has a double-ended configuration formed by neck portions at each end of a bulbous spherically shaped central portion with the symmetrically oriented electrode means being hermetically sealed in the neck portions. The sealed arc tube further contains a fill of various metal substances which become vaporized during lamp operation to include sodium, mercury and metal halides along with one or more rare inert gases such as krypton, argon and xenon. The symmetrically constructed metal vapor discharge lamps can be operated with power sources which deliver time varying current. Lamp operation with current varying at acoustic frequencies has been found particularly suitable for a variety of end-product applications such as reflector, spot and flood lamps or vehicle headlamps.

In the above referenced Ser. No. 07/579,129 application, now U.S. Pat. No. 5,121,034 means are provided to largely overcome various severe problems encountered with operation of such type lamps due to adverse acoustic resonance effects. The general nature of these problems is therein attributed to acoustic wave generation within the arc tube fill by lamp operation at current frequencies higher than the usual main frequency (60 Hz), for instance in the frequency range from 500 Hz to 1 MHz. Such acoustic wave patterns within the lamp envelope occasion changes in position of the discharge arc or its glowing aureole or plume, changes in the color of the emitted light and/or unstable discharge arcs resulting in flicker and sometimes extinction of the discharge arc. The problems are further said to be largely avoided by a method of lamp operation which forces a current having an alternating component causing instantaneous variation in input power across the discharge electrode gap with variations in power being at a frequency selected in preferred bands within the range from about 1 KHz up to about 1 MHz, the band being one in which acoustic resonance excites arc-straightening modes which reduce the effects of gravity-induced convection in the arc tube fill. Various embodiments for operating these lamps in such improved manner are also disclosed in the aforesaid co-pending application. One embodiment selects the preferred band so that acoustic resonance excites a mode effective to reduce gravity-induced bowing of the discharge, lower the hot spot temperature, and raise the cold spot temperature during lamp operation. Another embodiment employs alternating current having a waveshape providing time-fluctuation of input power at the selected frequency. In a further embodiment, the alternating component of the current through the lamp at the selected frequency is frequency-modulated in order to broaden the width of the band of frequencies in which a straight and stable arc is achieved. Still further embodiments are also disclosed employing a horizontal arc gap orientation parallel to the major or center lamp axis and which can further include employment of xenon as a radiation-emitting gas in the arc tube fill. In one such further lamp embodiment, the electrodes define a horizontal arc gap parallel to the major lamp axis, the radiation-emitting gas is xenon in a quantity exerting a partial pressure comparable to that of the mercury included in the arc tube fill, and wherein the arc tube fill further includes sodium being provided as a halide.

While acoustic operation of these type lamps in the foregoing manner is recognized to improve lamp performance, the symmetric lamp constructions remain sensitive to spatial orientation when being so operated. More particularly, such lamp constructions are frequently de-rated for non-vertical operation as well as further having occasioned special arc tube configurations for horizontal lamp operation. In the latter respect, bent arc tubes have been developed along with having displaced the discharge electrodes from the longitudinal center axis of the arc tube and with still further magnetic field compensation having been employed to improve performance of non-vertically operated lamps. Despite all such improvements directed primarily to providing a straighter arc discharge during non-vertical lamp operation in order to avoid deleterious heat convection effects, some asymmetric heating of the arc tube walls still takes place. Undesirable color separation of the arc discharge also occurs in the symmetric lamp constructions whereby the core of the principal discharge is observed to have a blue color while the edges of the discharge are observed to have a discernible red color. While acoustic lamp operation has also been observed to reduce color separation in the symmetric arc tube constructions, such improvement is found to often still remain transitory due to difficulty in maintaining a stable arc condition.

Accordingly, it is an object of the present invention to provide an improve metal halide lamp particularly adapted for lamp operation at acoustic frequencies and which exhibits less color separation in the principal arc discharge region.

It is a further object of the present invention to provide a xenon-metal halide lamp particularly suited for automotive applications.

It is another object of the present invention to provide a xenon-metal halide lamp less dependent upon spatial orientation when being operated.

Still a further object of the present invention is to provide an automotive headlamp employing such improved lamp construction for its light source.

These and other objects of the present invention will become apparent upon considering the following more detailed description.

SUMMARY OF THE INVENTION

The present invention is directed generally to improving the light output performance of a metal halide lamp when acoustically operated in a manner particularly suited for automotive and other end-product applications. Basically, suitable operating circuit means such as disclosed in the above referenced Ser. No. 07/579,129 application, now U.S. Pat. No. 5,121,034, can be employed for acoustic operation of a lamp constructed according to the present invention without experiencing the amount of color separation still being experienced with prior art lamps of this type. For example, a xenon-metal halide lamp having the presently improved construction can be provided with current signals having such time-varying component for acoustic operation in automotive headlamps and the like.

The presently improved metal halide lamp features asymmetric electrode means being provided at opposite ends of the arc tube cavity. By way of further explanation, a fused quartz arc tube is provided having a hollow cavity hermetically sealing a pair of spaced apart refractory metal electrode means therein, with one electrode means projecting into the hollow cavity a sufficiently greater distance than the other electrode means so as to displace the center point of the gap therebetween from the center point of the arc tube cavity. Such longitudinal off-center displacement of the electrode means has been found to provide operational benefits in tested xenon-metal halide lamps. The tested lamps exhibited less sensitivity to horizontal operation while desirably removing the red color edge of the arc discharge to one end of the arc tube where it exerts little influence upon the coloration of light output from the lamp. Additionally, halide condensate is removed to the far end of the tested lamps during operation so as not to block light emergence.

DETAILED DESCRIPTION OF THE PREFERRED EMBODIMENTS

Figure 1:
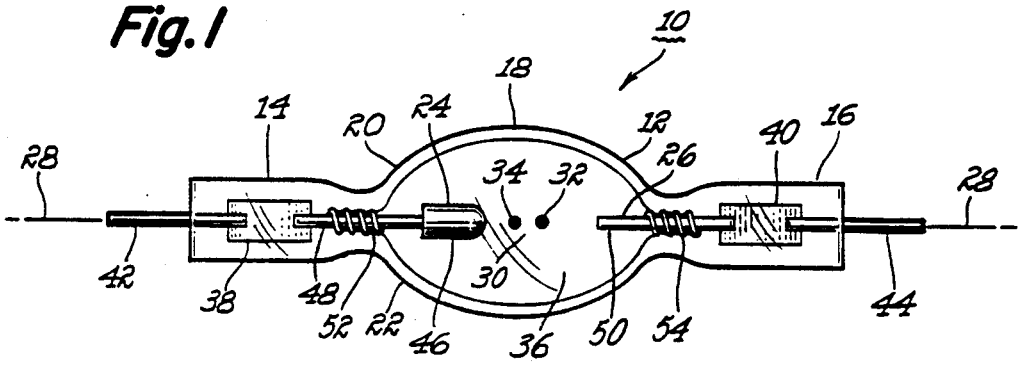
FIG. 1 is a side view depicting an arc tube for a metal halide lamp which employs asymmetrically disposed electrode means according to the present invention.

Referring to the drawings, FIG. 1 depicts a fused quartz arc tube 10 employing asymmetric electrode means according to the present invention. The arc tube member provides a suitable light source in various metal halide lamps, such as a high pressure xenon-metal halide lamp. As shown in the drawing, arc tube 10 has a double-ended configuration with an elongated hollow body 12 shaped to provide neck portions 14 and 16 at each end of a bulbous shaped central portion 18. Wall portions 20 and 22 of the hollow quartz body 12 hermetically seal a pair of discharge electrodes 24 and 26 at opposite ends of the bulbous mid-portion 18 which are separated from each other by a predetermined distance in the range from about two to about four millimeters. As shown in the drawing, both electrode means 24 and 26 are physically disposed along the longitudinal center axis 28 of the hollow quartz body 12 to establish an arc gap 30 therebetween having a center point 32. It can be further noted that center point 32 is physically displaced along the longitudinal center axis from the center point 34 in the hollow arc tube cavity 36 thereby providing asymmetric positioning of the arc discharge during lamp operation. Anode and cathode electrode members 24 and 26, respectively, both comprise rod-like members formed with a refractory metal such as tungsten or tungsten alloy and are configured to be of dissimilar physical size and construction for improved light output when operated. The electrode members are also of the already known spot-mode type so as to provide a thermonic arc condition within arc tube 10 in a substantially instantaneous manner. Both electrode means 24 and 26 are hermetically sealed within the quartz envelope 12 with thin refractory metal foil elements 38 and 40 that are further connected to outer lead wire conductors 42 and 44, respectively. A fill (not shown) of xenon, mercury and a metal halide which is further contained within the bulbous shaped and now sealed hollow cavity 18 of the quartz envelope provides substantially instant light emission. Refractory metal coils 52 and 54 serve only to centrally position the electrode members at the end of the sealed arc tube envelope.

Representative 30 watt size xenon-metal halide lamps having the above defined asymmetrically oriented discharge electrode configuration were constructed for evaluation. The tested lamps employ an arc tube constructed with fused quartz that included minor amounts of ceria and titania doping agents for reduced ultraviolet output during the lamp operation. The completed arc tube measured approximately 8.8 millimeters at the mid-point outer diameter with an inside diameter of approximately 6. millimeters. A bullet shaped anode electrode member was employed in the tested lamps together with a smaller sized rod-like cathode electrode member and with both of the electrode members being formed with a conventional tungsten alloy. Anode electrode 24 included an enlarged bullet shaped distal end 46 of approximately 2.5 millimeters in length and 0.040 inches in diameter. Enlarged distal end 46 of anode electrode member 24 was joined to a tungsten shank 48 having an approximate diameter of 0.016 inches. Cathode electrode means 26 in the tested lamp configuration had a rod-like distal end 50 also formed with conventional tungsten alloy to have an approximate 0.009 inch diameter. Asymmetric electrode displacement was achieved with both electrode means being physically aligned along horizontal center axis 28 of the hollow arc tube cavity 36. In doing so, the anode electrode 24 was shifted approximately 0.5 millimeters toward the arc tube center point 34 whereas the cathode electrode 26 was correspondingly displaced an equal distance in the same direction thereby shifting the center of the arc gap between the electrode members approximately 0.5 millimeters from the arc tube center point. The fill materials employed in the tested lamps included approximately 1.4 milligrams mercury along with approximately 1.8 milligrams of a commercial halide mixture containing approximately 80 percent by weight of sodium iodide and approximately 20 percent by weight scandium iodide. Xenon gas at a fill pressure of approximately 5.8 atmospheres was further contained in the arc tube cavity.

The above described test lamps were operated in the same manner as described in the above referenced Ser. No. 07/579,129 application, now U.S. Pat. No. 5,121,034. Horizontal operation of these lamps observed the arc discharge to be about the same as experienced with vertical lamp operation. Less color separation also occurred for the tested lamps whereby the red edges of the arc discharge were pushed to the cathode end of the arc tube for effective removal from the principal lamp emission. Displacement of the halide condensate to the anode end of the arc tube was also observed thereby serving to further improve the lamp light output performance. Possible further enhancement of the observed improvements might be achieved with additional shifting of the arc gap within the arc tube.

Figure 2:
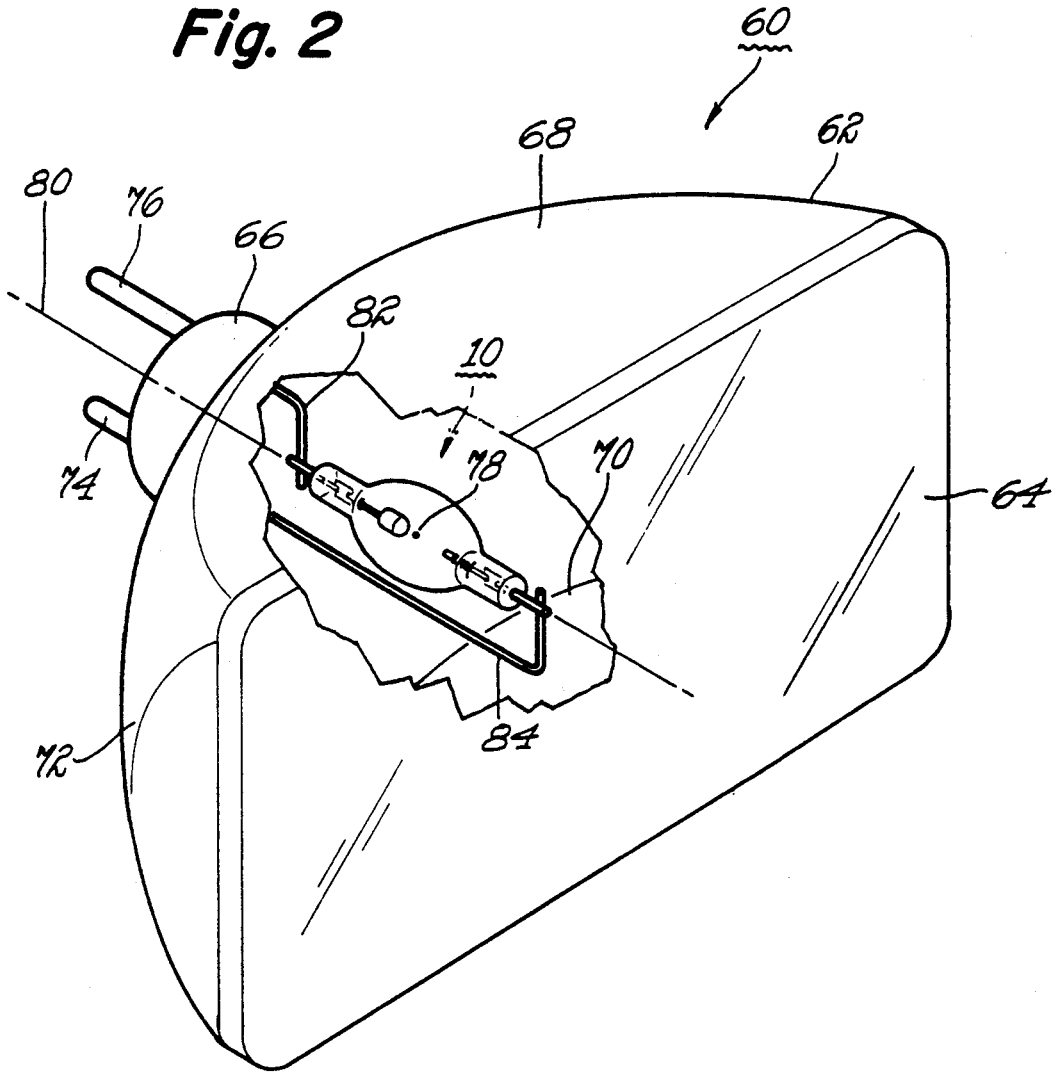
FIG. 2 is a perspective view depicting an automotive headlamp incorporating the quartz arc tube of FIG. 1 oriented in a horizontal axial manner.

FIG. 2 is a perspective view depicting an automotive headlamp incorporating the quartz arc tube 10 of FIG. 1. Accordingly, the automotive headlamp 60 comprises reflector member 62, a lens member 64 secured to the front section of the reflector member, connection means 66 secured at the rear section of the reflector member for connection to a power source, and the previously described metal halide light source 10. The reflector member 62 has a truncated parabolic contour with flat top and bottom wall portions 68 and 70, respectively, intersecting a parabolic curved portion 72. Connection means 66 of the reflector member includes prongs 74 and 76 which are capable of being connected to a ballast (not shown) which drives the lamp and which in turn is driven by the power source of the automotive vehicle. Reflector member 62 has a predetermined focal point 78 as measured along the axis 80 of the automotive headlamp 60 and located at about the mid-portion of the arc tube 10. Arc tube 10 is horizontally positioned within the reflector 62 so as to be approximately disposed at the focal point 78 of the reflector. For the presently illustrated embodiment, arc tube member 10 is oriented along axis 80 of the reflector. The reflector cooperates with light source 10 by reason of its parabolic shape and with lens member 64 affixed thereto being of an optically transparent material which can include prism elements (not shown) also cooperating to provide a predetermined forward projecting light beam therefrom. Arc tube 10 is connected to the rear section of reflector 62 by a pair of relatively stiff self-supporting lead conductors 82 and 84 which are further connected at the opposite ends to the respective prong elements 74 and 76. Since it will be apparent to those skilled in the art that still other structural arrangements can be found for suitably orienting the presently modified lamp in other already known reflector designs, it is not intended to limit such headlamp configurations to the herein illustrated embodiment.

Figure 3:
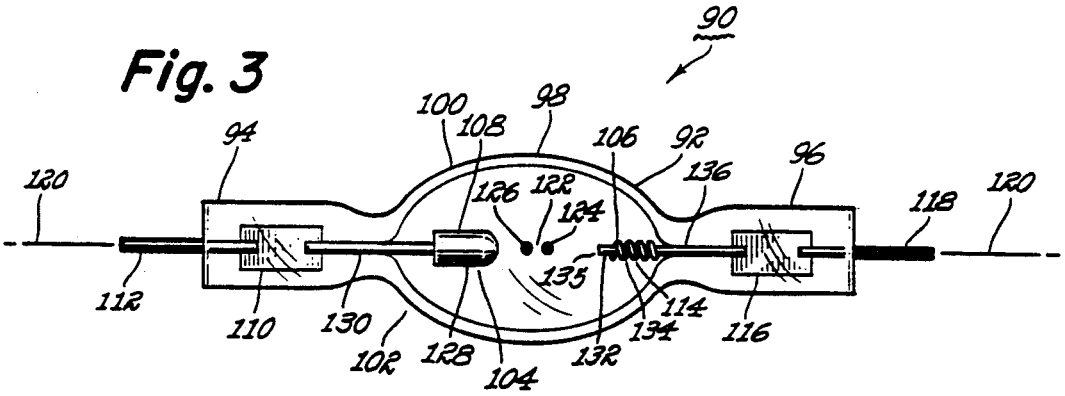
FIG. 3 is a side view depicting a different arc tube of the present invention.

FIG. 3 is a side view depicting a different fused quartz arc tube 90 employing asymmetrically-oriented electrode means of the present invention. A xenon-metal halide lamp employing such arc tube configuration promotes more rapid light output during lamp start-up again when operated in the same manner defined for the lamp embodiment of FIG. 1. Operation of the herein defined embodiment thereby provides the same operational benefits attributable to employment of asymmetric electrode means while additionally reducing mercury condensation upon the arc tube walls during lamp start-up or restart at a location impeding light emergence from the arc tube. The latter benefit is attributable to a still further modification of the discharge electrode means herein employed whereby the cathode means exhibits a more rapid heating rate than the anode means when electrical power is first applied while further exhibiting a less rapid cooling rate than the anode means when electrical power is turned off. Accordingly, the arc tube employs a double-ended hollow quartz body 92 providing neck sections 94 and 96 at each end of a bulbous shaped central cavity 98. Wall portions 100 and 102 of the hollow quartz envelope 92 hermetically seals the electrode means 104 and 106, respectively, at opposite ends of the bulbous mid-portion 98. Anode means 104 again comprises an electrode member 108 hermetically sealed within the hollow cavity 98 with a thin refractory metal sealing element 110 which is connected at the opposite end to outer lead conductor 112. Similarly, cathode means 106 also employs an electrode member 114 hermetically sealed within the opposite end of hollow cavity 98 with a refractory metal sealing element 116 and with the opposite end of the sealing element being connected to outer lead conductor 118. As can again be seen in the present drawing, both electrode means 104 and means 106 are physically disposed along the longitudinal center axis 120 of the hollow quartz body 92 to provide an arc gap 122 therebetween having a center point 124. The arc gap center point 124 can also be seen to be displaced a preselected distance along the longitudinal axis from the center point 126 in the hollow arc tube cavity 98. Anode electrode member 108 is significantly larger in physical size than cathode electrode member 114 and has a bullet shaped distal end 128 sufficient in physical size to withstand a starting current without melting the refractory metal selected for its formation. The enlarged distal end 128 of the anode electrode member is joined to a refractory metal shank 130. Cathode electrode member 114 has a distal end 132 formed with a refractory metal helix 134 which is joined at its outer terminal end to a first refractory metal shank 135 while further being joined at its inner terminal end to a second refractory metal shank 136. During lamp start-up with the herein depicted anode and cathode means, thermal management of mercury condensation upon both electrode members occurs in an improved manner. Mercury is vaporized more slowly from the larger sized distal end of the anode electrode due to slower warming of its larger thermal mass. Accordingly, mercury condenses more slowly upon the inner arc tube wall surfaces at a location which can block or absorb the initial xenon light output. Additional thermal management of mercury within the depicted arc tube construction is provided with the particular cathode means being employed. The helical configuration being utilized in the cathode electrode member serves to lengthen the heat conduction path therein to provide means for controlling thermal operation between anode and cathode means both during lamp start-up and cool down. By managing thermal conduction within the arc tube in such manner, the anode means warms more slowly during lamp start-up for less mercury condensation on the arc tube walls at a location impeding light emergence while desirably further increasing mercury deposition on the anode means during lamp cool-down.

It will be apparent from the foregoing description that improved means have been provided to more effectively operate metal halide lamps. It will be apparent that significant further modifications can be made in physical features of suitable electrode means achieving the desired purpose than herein specifically illustrated, however, without departing from the true spirit and scope of the present invention. Accordingly, still other configurations for a fused quartz arc tube, electrode members and reflector lamp designs than herein illustrated are also contemplated. For example, a cylindrical or ovoid quartz arc tube shape can employ the same anode and cathode means herein illustrated with comparable beneficial results. Likewise an automotive headlamp construction having the light source aligned transverse to the lamp axis and which includes the present anode and cathode means is also contemplated. Consequently, it is intended to limit the present invention only by the scope of the appended claims.

What we claim as new and desire to secure by Letters Patent of the United States is:

1. A metal halide lamp designed to operate at an acoustically resonant frequency band for improved stability, said metal halide lamp comprising:

(a) a fused quartz arc tube having a hollow cavity hermetically sealing a pair of spaced apart refractory metal electrode means therein and further containing a fill of mercury, a metal halide and an inert gas which is excited to a discharge state at said acoustically resonant frequency band, (b) the electrode means being disposed at opposite ends of the hollow cavity and being spaced apart from each other to enable an arc gap therebetween, both electrode means further residing substantially along the longitudinally center axis of the arc tube, and (c) one electrode means projecting into the hollow cavity a sufficiently greater distance than the other electrode means so as to displace the center point of the gap therebetween from the center point of the arc tube cavity.

2. The lamp of claim 1 wherein the arc tube has a double-ended configuration formed by neck portions at each end of a bulbous shaped central portion providing the hollow cavity, the electrode means being hermetically sealed in the neck portions.

3. The lamp of claim 1 wherein each electrode means comprises an electrode member connected to a refractory metal foil sealing element which is further connected to an outer lead conductor.

4. The lamp of claim 3 wherein the one electrode member is significantly larger in physical size than the other electrode member.

5. The lamp of claim 3 wherein one electrode member has a distal end formed with a refractory metal helix joined at opposite ends to a pair of refractory metal shanks.

6. A xenon-metal halide lamp designed to operate at an acoustically resonant frequency band for improved stability, said xenon-metal halide lamp comprising:

(a) a fused quartz arc tube having a hollow cavity hermetically sealing a pair of spaced-apart refractory metal discharge electrodes therein and further containing a fill of mercury, a metal halide and xenon gas at a relatively high fill pressure which is excited to a discharge state at said acoustically resonant frequency band, (b) the discharge electrode serving as the cathode having a distal end formed with a refractory metal helix being joined at opposite ends to a pair of refractory metal shanks, (c) the discharge electrode serving as the anode having a rod-like configuration with an enlarged refractory metal distal end significantly greater in physical size than the cathode and being joined to a refractory metal shank, (d) both discharge electrodes being disposed at opposite ends of the hollow cavity and being spaced apart from each other to enable an arc gap therebetween, both discharge electrodes further residing substantially along the longitudinal center axis of the arc tube, and (e) the anode electrode projecting into the hollow cavity a sufficiently greater distance than the cathode electrode so as to displace the center point of the gap therebetween from the center point of the arc tube cavity.

7. An automotive headlamp designed to operate at an acoustically resonant frequency band for improved stability, said automotive headlamp comprising:

(a) a reflector member for connection to a power source, the reflector member having a predetermined focal length and focal point, (b) a lens member joined to the front section of the reflector, and (c) a fused quartz arc tube predeterminently positioned within the reflector so as to be approximately disposed adjacent the focal point of the reflector, the fused quartz arc tube having a hollow cavity hermetically sealing a pair of spaced-apart refractory metal electrode means therein and further containing a fill of mercury, a metal halide and inert gas at a relatively high fill pressure which is excited to a discharge state at said acoustically resonant frequency band, (d) the electrode means being disposed at opposite ends of the hollow cavity and being spaced apart from each other to enable an arc gap therebetween, both electrode means further residing substantially along the longitudinal center axis of the arc tube, and one electrode means projecting into the hollow cavity a sufficiently greater distance than the other electrode means so as to displace the center point of the gap therebetween from the center point of the arc tube cavity.

* * * * *